US007901266B2

(12) United States Patent
Ostendorff

(10) Patent No.: US 7,901,266 B2
(45) Date of Patent: Mar. 8, 2011

(54) TOY VEHICLE COLLISION SET

(75) Inventor: Eric Ostendorff, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 937 days.

(21) Appl. No.: 11/744,747

(22) Filed: May 4, 2007

(65) Prior Publication Data

US 2008/0020675 A1 Jan. 24, 2008

Related U.S. Application Data

(60) Provisional application No. 60/798,010, filed on May 4, 2006, provisional application No. 60/812,190, filed on Jun. 9, 2006.

(51) Int. Cl.
*A63H 29/00* (2006.01)

(52) U.S. Cl. ..... 446/429; 446/431; 446/6; 446/444; 446/437; 104/53

(58) Field of Classification Search ..... 446/433, 446/437, 444, 429–431, 6; 273/108; 238/10 E, 238/10 F; 104/53
See application file for complete search history.

(56) References Cited

U.S. PATENT DOCUMENTS

| | | | | |
|---|---|---|---|---|
| 770,071 | A | 9/1904 | Johnson | |
| 783,812 | A | 2/1905 | Ancillotti | |
| 795,087 | A | 7/1905 | Alonso-Perez | |
| 798,966 | A | 9/1905 | Johnson | |
| 812,595 | A | 2/1906 | Roberts | |
| 1,527,006 | A | 2/1925 | O'Reilly | |
| 1,599,982 | A | 9/1926 | Bauer | |
| 3,411,783 | A | 11/1968 | Montagna | |
| 3,502,332 | A * | 3/1970 | Wolf | 463/69 |
| 3,559,335 | A | 2/1971 | See et al. | |
| 3,572,711 | A | 3/1971 | Conklin et al. | |
| 3,590,524 | A | 7/1971 | Beny et al. | |
| 3,599,365 | A | 8/1971 | Carver et al. | |
| 3,621,602 | A | 11/1971 | Barcus et al. | |
| 3,633,902 | A | 1/1972 | Worden | |
| 3,636,651 | A | 1/1972 | Lohr et al. | |
| 3,641,784 | A | 2/1972 | Schlichtig | |
| 3,814,021 | A * | 6/1974 | McHenry | 104/69 |

(Continued)

FOREIGN PATENT DOCUMENTS

GB 2113560 A 8/1983

(Continued)

OTHER PUBLICATIONS

Mattel 1989 Product Catalogue, 2 pages.

(Continued)

*Primary Examiner* — Gene Kim
*Assistant Examiner* — Scott Young
(74) *Attorney, Agent, or Firm* — Edell, Shapiro & Finnan

(57) ABSTRACT

A toy vehicle collision set. The toy vehicle collision set includes a plurality of launchers that propel collision vehicles through the air. The launchers are aimed to propel the plurality of collision vehicles into a collision zone. The collision vehicles fired from the launchers can collide in the collision zone when fired from the launchers. The toy vehicle collision set further includes a track that directs a target vehicle along a path of travel. The path of travel includes an airborne segment in which the target vehicle jumps across the collision zone. Collision vehicles fired from the launchers can be used to knock the target vehicle off its path of travel.

17 Claims, 5 Drawing Sheets

U.S. PATENT DOCUMENTS 3,844,557 A 10/1974 Pompetti
4,016,674 A 4/1977 Resnick et al.
4,070,024 A 1/1978 Hamano
4,108,437 A * 8/1978 DeAnda et al. ..... 463/59
4,174,587 A 11/1979 Morin et al.
4,267,661 A 5/1981 Hanson
4,295,649 A 10/1981 Cooper
4,330,127 A 5/1982 Brand et al.
4,363,186 A 12/1982 Goldfarb et al.
4,364,566 A 12/1982 Neuhierl
4,373,293 A 2/1983 Kakizaki et al.
4,383,688 A 5/1983 Prehodka
4,394,961 A 7/1983 Muller
4,403,440 A 9/1983 Wulff
4,415,157 A 11/1983 Lahr
4,423,871 A * 1/1984 Mucaro ..... 463/64
4,433,504 A 2/1984 Terui
4,472,906 A 9/1984 Cook et al.
4,475,303 A 10/1984 Ribas et al.
4,504,242 A 3/1985 Crain et al.
4,511,342 A 4/1985 Hart et al.
4,513,966 A * 4/1985 Mucaro et al. ..... 238/10 F
4,513,967 A 4/1985 Halford et al.
4,519,789 A * 5/1985 Halford et al. ..... 446/444
4,536,168 A 8/1985 Stephens
4,558,867 A * 12/1985 Hippely ..... 273/412
4,605,230 A * 8/1986 Halford et al. ..... 273/129 AP
4,642,066 A * 2/1987 Kennedy et al. ..... 446/420
4,715,843 A 12/1987 Ostendorff et al.
4,732,569 A 3/1988 Hippely et al.
4,767,053 A 8/1988 Cook et al.
5,038,685 A 8/1991 Yoneda et al.
5,052,972 A 10/1991 Suimon et al.
5,102,133 A 4/1992 Chilton et al.
5,125,010 A 6/1992 Lee et al.
5,165,347 A 11/1992 Wagner
5,174,569 A 12/1992 Ngai
5,205,554 A * 4/1993 Copson ..... 463/62
5,234,216 A * 8/1993 Ostendorff ..... 273/127 A
5,252,085 A 10/1993 Kato et al.
5,254,030 A 10/1993 Ostendorff et al.
5,299,969 A * 4/1994 Zaruba ..... 446/429
5,370,571 A * 12/1994 Bosch ..... 446/429
5,402,730 A 4/1995 Salter et al.
5,460,560 A 10/1995 Liu
5,522,752 A 6/1996 Liu
5,823,848 A 10/1998 Cummings
5,899,789 A 5/1999 Rehkemper et al.
5,906,528 A 5/1999 Ostendorff et al.
6,000,992 A * 12/1999 Lambert ..... 446/430
6,089,951 A 7/2000 Ostendorff
6,109,186 A 8/2000 Smith et al.
6,179,686 B1 1/2001 Ogawa et al.
6,213,466 B1 4/2001 Rosen
6,241,573 B1 * 6/2001 Ostendorff et al. ..... 446/444
6,435,929 B1 * 8/2002 Halford ..... 446/6
6,478,654 B1 11/2002 Rehkemper et al.
6,575,809 B2 6/2003 Ogawa et al.
6,676,480 B2 1/2004 Sheltman
6,805,609 B1 10/2004 Paukert et al.
6,913,508 B2 7/2005 Hornsby et al.
6,951,497 B1 * 10/2005 Ngan ..... 446/444
2003/0224696 A1 12/2003 Sheltman
2003/0224697 A1 12/2003 Shetlman et al.
2004/0198166 A1 10/2004 Newbold
2005/0148281 A1 7/2005 Sanchez-Castro et al.
2005/0191938 A1 9/2005 Sheltman et al.
2005/0191939 A1 9/2005 Sheltman et al.
2005/0191940 A1 9/2005 Sheltman et al.
2005/0287914 A1 12/2005 Sheltman et al.
2005/0287915 A1 12/2005 Sheltman et al.
2005/0287916 A1 12/2005 Sheltman et al.
2005/0287917 A1 12/2005 Sheltman et al.
2005/0287918 A1 12/2005 Sheltman et al.
2005/0287919 A1 12/2005 Sheltman et al.
2007/0293122 A1 * 12/2007 O'Connor et al. ..... 446/429

FOREIGN PATENT DOCUMENTS

GB 2130903 A 6/1984
GB 2200297 A 8/1988
JP 2005204820 A 8/2005
WO WO 9201497 A1 2/1992
WO WO 9949948 A1 * 10/1999
WO WO 0211849 A 2/2002

OTHER PUBLICATIONS

Mattel 1996 Product Catalogue, 2 pages.
Mattel 1996 Product Catalogue, 4 pages.

* cited by examiner

Fig. 2
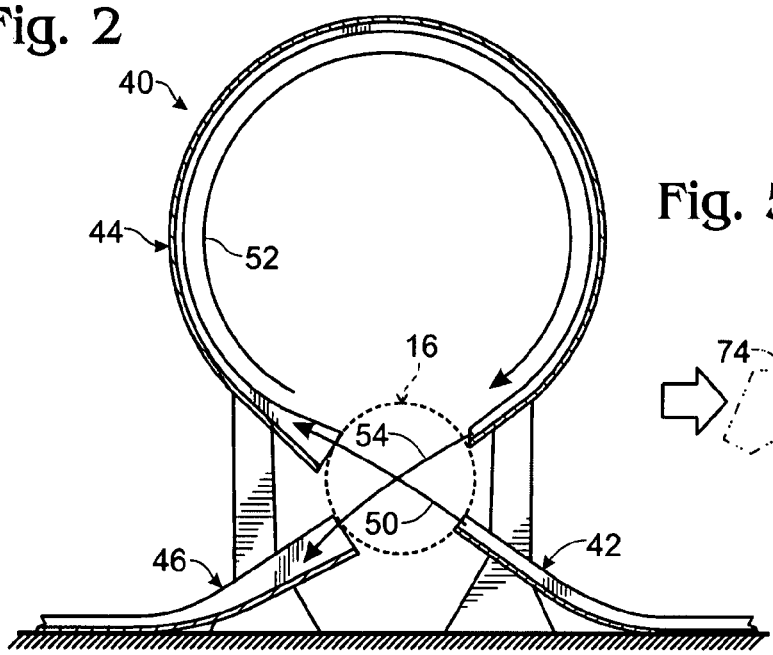
Fig. 5
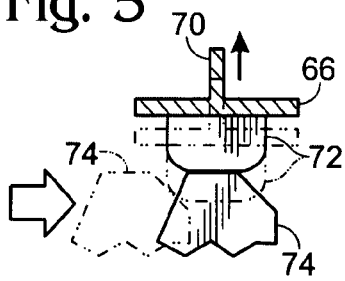
Fig. 3
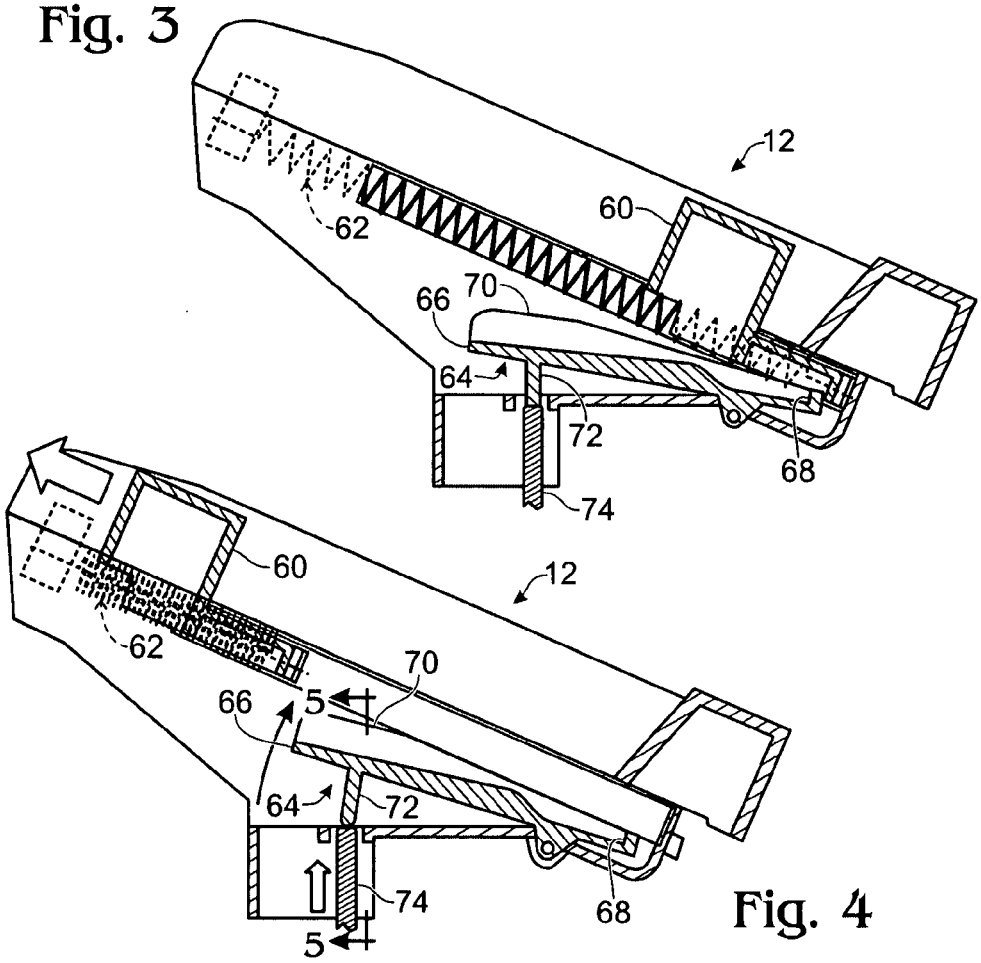
Fig. 4

TOY VEHICLE COLLISION SET

CROSS REFERENCE TO RELATED APPLICATIONS

This application claims the benefit of U.S. Provisional Application Nos. 60/798,010, filed May 4, 2006; and 60/812,190, filed Jun. 9, 2006. Both applications are incorporated by reference.

BACKGROUND

Toy vehicle track sets may include one or more track sections arranged to form a path around which one or more toy vehicles can travel. The toy vehicles may be either self-powered or receive power from an external source. Such tracks can include various turns, twists, rolls, loops, and other features that increase playing enjoyment.

SUMMARY

A toy vehicle collision set is provided. The toy vehicle collision set includes a plurality of launchers that propel collision vehicles through the air. The launchers are aimed to propel the plurality of collision vehicles into a collision zone. The collision vehicles fired from the launchers can collide in the collision zone when fired from the launchers. The toy vehicle collision set further includes a track that directs a target vehicle along a path of travel. The path of travel includes an airborne segment in which the target vehicle jumps across the collision zone. Collision vehicles fired from the launchers can be used to knock the target vehicle off its path of travel.

BRIEF DESCRIPTION OF THE DRAWINGS

FIG. 2 is a cross-sectional view of a stunt loop portion of the track set from FIG. 1.

FIG. 3 is a cross-sectional view of a launcher from FIG. 1 when the launcher is cocked for firing.

FIG. 4 is a cross-sectional view of the launcher from FIG. 3 after the launcher is activated.

FIG. 5 shows a traveler activating the launcher of FIG. 3 by raising a trigger on the launcher.

WRITTEN DESCRIPTION

Figure 1:
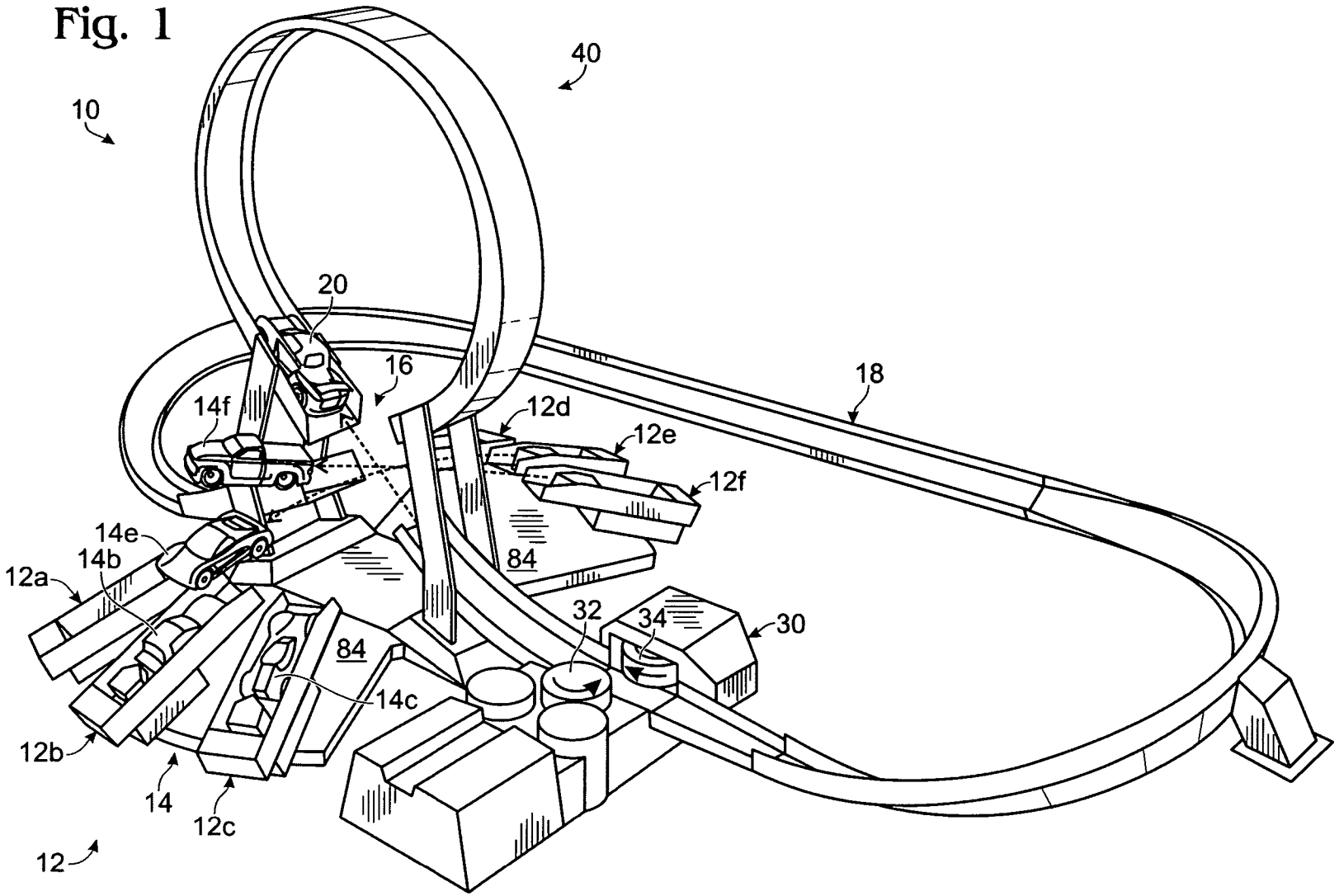
FIG. 1 shows a toy vehicle track set including a plurality of launchers aimed to propel collision vehicles into a collision zone through which a target vehicle passes when traveling around a track.

The present disclosure is directed to a toy vehicle collision set that emphasizes vehicle crashing. FIG. 1 shows a nonlimiting example of a collision set in the form of a toy vehicle track set 10. Track set 10 includes a plurality of launchers 12 (e.g., 12*a*, 12*b*, 12*c*, 12*d*, 12*e*, and 12*f*) that are configured to propel collision vehicles 14 (e.g., 14*b*, 14*c*, 14*e*, and 14*f*) into a collision zone 16. Track set 10 also includes a track 18 that directs a target vehicle 20 through the collision zone. As described in detail below, one or more collision vehicles can be launched into the collision zone in an attempt to knock the target vehicle off its path, and/or two or more collision vehicles can be launched so as to crash into each other in the collision zone.

Track set 10 includes a booster 30 for accelerating target vehicle 20. Booster 30 includes a pair of spaced apart spinning wheels 32 and 34. In the illustrated embodiment, battery power is used to spin wheels 32 and 34, although this is not required. Virtually any other power source may be used. As target vehicle 20 travels between spinning wheels 32 and 34, the spinning wheels grip the sides of the target vehicle and shoot it forward. Booster 30 is provided as a nonlimiting example of a device which can be used to accelerate target vehicle 20. It is to be understood that other accelerators can be used. For example, an alternative track configuration may use a ramp that allows gravity to accelerate the target vehicle.

In the illustrated embodiment, track set 10 includes a stunt loop 40 positioned after booster 30. Other track arrangements can be implemented without departing from the scope of this disclosure. Some embodiments may not include any track, but instead may include only launchers for propelling vehicles into a collision zone.

FIG. 2 is a cross-sectional view of stunt loop 40. Stunt loop 40 includes a jump segment 42, a loop segment 44, and a landing segment 46. As indicated at arrow 50, jump segment 42 can launch a target vehicle into an airborne path of travel across a gap between the jump segment and the loop segment. Loop segment 44 can catch the target vehicle from its airborne path of travel. As indicated at arrow 52, the loop segment can then direct the target vehicle upward to an apex of the loop and then downward around the loop. As indicated at arrow 54, the loop segment may then launch the target vehicle into an airborne path of travel across a gap between the loop segment and landing segment 46. The landing segment can catch the target vehicle from its airborne path of travel.

Stunt loop 40 is configured in a substantially planar vertical configuration. As such, the airborne path of travel from the jump segment to the loop segment intersects the airborne path of travel from the loop segment to the landing segment. In other words, the gap the target vehicle jumps when entering the loop occupies the same space as the gap the target vehicle jumps when exiting the loop. This space can be referred to as collision zone 16.

Turning back to FIG. 1, it is to be appreciated that launchers 12 are all aimed to propel collision vehicles into collision zone 16. As such, one or more of the collision vehicles can be used to knock the target vehicle off its path as the target vehicle jumps onto or off of the loop. In particular, a user can time the launching of one or more of the collision vehicles in an attempt to cause the collision vehicle to collide with the target vehicle in the collision zone.

Virtually any type of launcher can be used without departing from the scope of this disclosure. FIGS. 3 and 4 show a nonlimiting example of one such launcher. Launcher 12 includes a thruster 60 that can be cocked back under tension from springs 62. A catch assembly 64 is configured to hold the thruster in its cocked position. Catch assembly 64 includes a counterweight 66 that biases a catch 68 in an upward position. Catch 68 can hold the thruster in its cocked position when the catch is in its upward position. Catch 68 temporarily pivots downward when the thruster is cocked back, thus allowing the thruster to slide over the catch. In particular, catch assembly 68 includes a fin 70 that the thruster pushes against as it is slid back into its cocked position. When the thruster pushes against the fin, the catch is moved downward against the gravitational bias of the counterweight, allowing the thruster to be moved back into its cocked position. Once back in its cocked position, the counterweight again biases the catch in its upward position, where it holds the thruster in the cocked position.

The catch assembly also includes a trigger 72. When the trigger is pushed upward, catch 68 pivots downward, releasing the thruster from its cocked position. FIG. 5 shows a nonlimiting mechanism for pushing trigger 72 upward. In the illustrated embodiment, a traveler 74 is aligned with trigger 72. The traveler has a ramped surface that can lift the trigger as the traveler moves laterally. Therefore, the traveler can activate the launcher by laterally moving under the trigger so as to lift the trigger.

Figure 6:
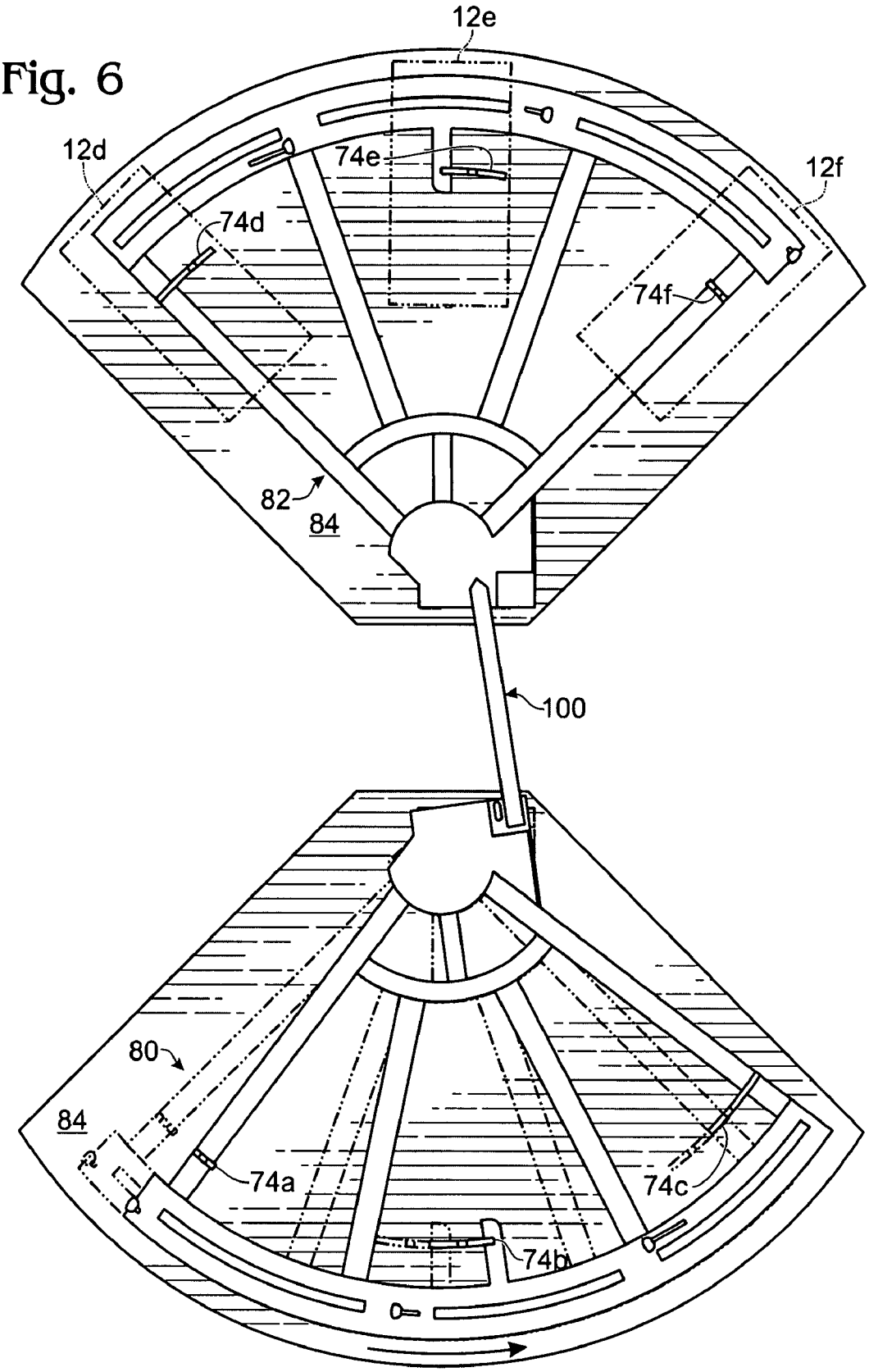
FIG. 6 shows first and second trigger assemblies for activating the launchers of FIG. 1.

FIG. 6 shows a first common trigger assembly 80 including three travelers 74*a*, 74*b*, and 74*c* for activating a first group of three launchers (e.g., launchers 12*a*, 12*b*, and 12*c* from FIG. 1), and a second common trigger assembly 82 including three travelers 74*d*, 74*e*, and 74*f* for activating a second group of three launchers (e.g., launchers 12*d*, 12*e*, and 12*f* from FIG. 1). For the sake of clarity and simplicity, the launchers are not illustrated in FIG. 6, although the position of launchers 12*d*, 12*e*, and 12*f* are shown in dashed lines. It is to be understood that the launchers can be mounted to a launcher platform 84, as shown in FIG. 1.

As shown in FIG. 6, travelers 74*a*, 74*b*, and 74*c* move together. Therefore, it is possible to fire launchers 12*a*, 12*b*, and 12*c* substantially simultaneously. By firing the launchers substantially simultaneously, three collision vehicles can be propelled into the collision zone at substantially the same time, thus creating a mid-air collision at the collision zone. If the launching of the collision vehicles is properly timed, one or more of the collision vehicles may also collide with the target vehicle as it jumps across the collision zone.

Figure 7A:
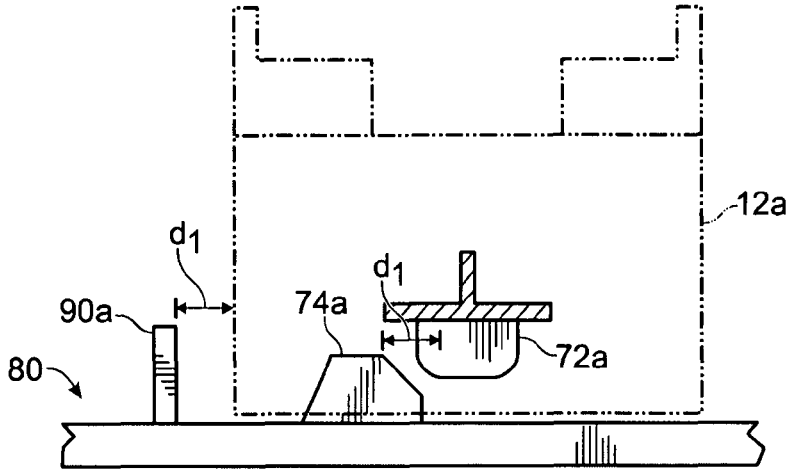
FIGS. 7A, 7B, and 7C show the differing triggering distances of the launchers of FIG. 1.

Common triggering assembly 80 also is configured for sequentially firing the launchers. This is accomplished by varying the distance between the trigger of each launcher and its corresponding traveler. For example, FIG. 7A shows a trigger 72*a* and its corresponding traveler 74*a*. Trigger 72*a* is the trigger of launcher 12*a* (shown in FIG. 1). The traveler is separated from the firing point of the trigger by a distance $d_1$. In other words, the traveler must move at least the distance $d_1$ before trigger 72*a* will activate launcher 12*a*. The distance $d_1$ can be referred to as the triggering distance of launcher 12*a*.

Figure 7B:
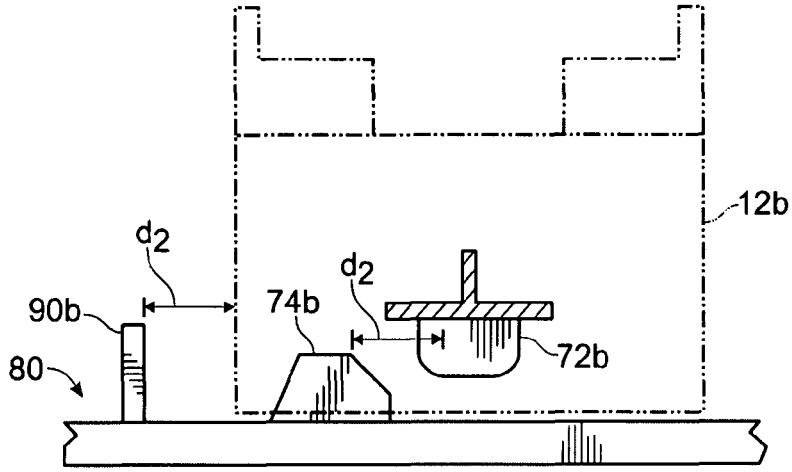
Figure 7C:
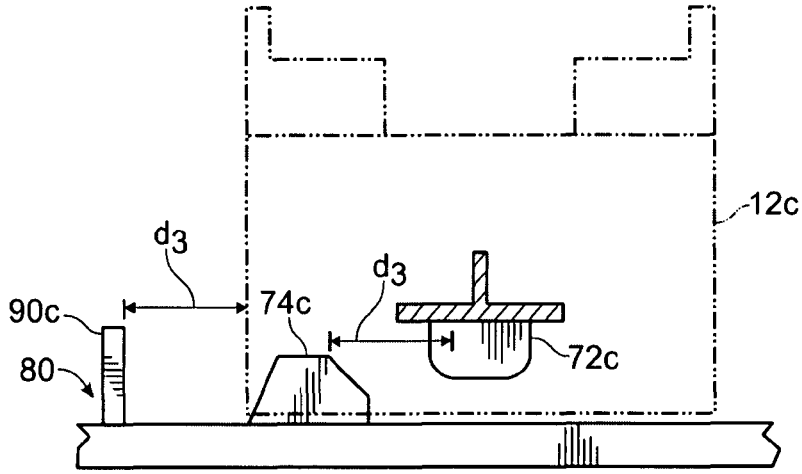

FIGS. 7B and 7C show the triggering distances for launchers 12*b* and 12*c*, respectively. In particular, the triggering distance for launcher 12*b* is $d_2$, and the triggering distance for launcher 12*c* is $d_3$, where $d_1<d_2<d_3$.

The progressively increasing triggering distances allow the launchers to be fired sequentially. When the common triggering assembly is moved by a distance $d_1$, the first launcher 12*a* fires, but launchers 12*b* and 12*c* remain cocked. After the first launcher is fired, the common triggering assembly can be further moved so that it travels a total distance of $d_2$, at which point the second launcher 12*b* fires, while launcher 12*c* remains cocked. Then, the common triggering assembly can be further moved to travel a total distance of $d_3$, at which point the third launcher 12*c* fires. In this way, the launchers can be fired one at a time.

Substantially simultaneous firing can be achieved by cocking all three launchers, and then quickly moving the common triggering assembly a distance $d_3$. This causes all three launchers to be fired in the same triggering motion.

As shown in FIGS. 7A, 7B, and 7C, the common triggering assembly can include three user-manipulable levers 90*a*, 90*b*, and 90*c*. User-manipulable lever 90*a* is spaced from a side surface of launcher 12*a* by the distance $d_1$. Therefore, if the user-manipulable lever is pressed, the side of the launcher will confine the movement of the common trigger assembly to the distance $d_1$. In particular, the side of launcher 12*a* blocks the finger of the user from pushing lever 90*a* any further. Therefore, user-manipulable lever 90*a* can be used to fire launcher 12*a* independently of the other launchers.

User-manipulable lever 90*b* is spaced away from a side surface of launcher 12*b* by the distance $d_2$, and user-manipulable lever 90*c* is spaced away from a side surface of launcher 12*c* by the distance $d_3$. The relative spacing of the user-manipulable levers and the corresponding launchers provides a guide that assists a user in moving the common trigger assembly by a desired triggering distance.

The different triggering distances facilitate activating the launchers sequentially or activating the launchers substantially simultaneously, depending on which lever a user selects to move the common trigger assembly. For example, with all launchers cocked, user-manipulable lever 90*a* can be pressed toward launcher 12*a* to fire only launcher 12*a*.

Alternatively, user-manipulable lever 90*b* can be pressed toward launcher 12*b* to fire both launchers 12*a* and 12*b*. When lever 90*b* is pressed toward launcher 12*b*, the side of launcher 12*b* blocks the finger of the user from pushing lever 90*b* any further. When lever 90*b* is pressed toward launcher 12*b*, lever 90*a* travels through an opening in the side of launcher 12*a*.

All launchers can be fired with the same triggering motion by pressing lever 90*c* toward launcher 12*c*, while lever 90*a* travels through an opening in the side of launcher 12*a*, and lever 90*b* travels through an opening in the side of launcher 12*b*.

Figure 8:
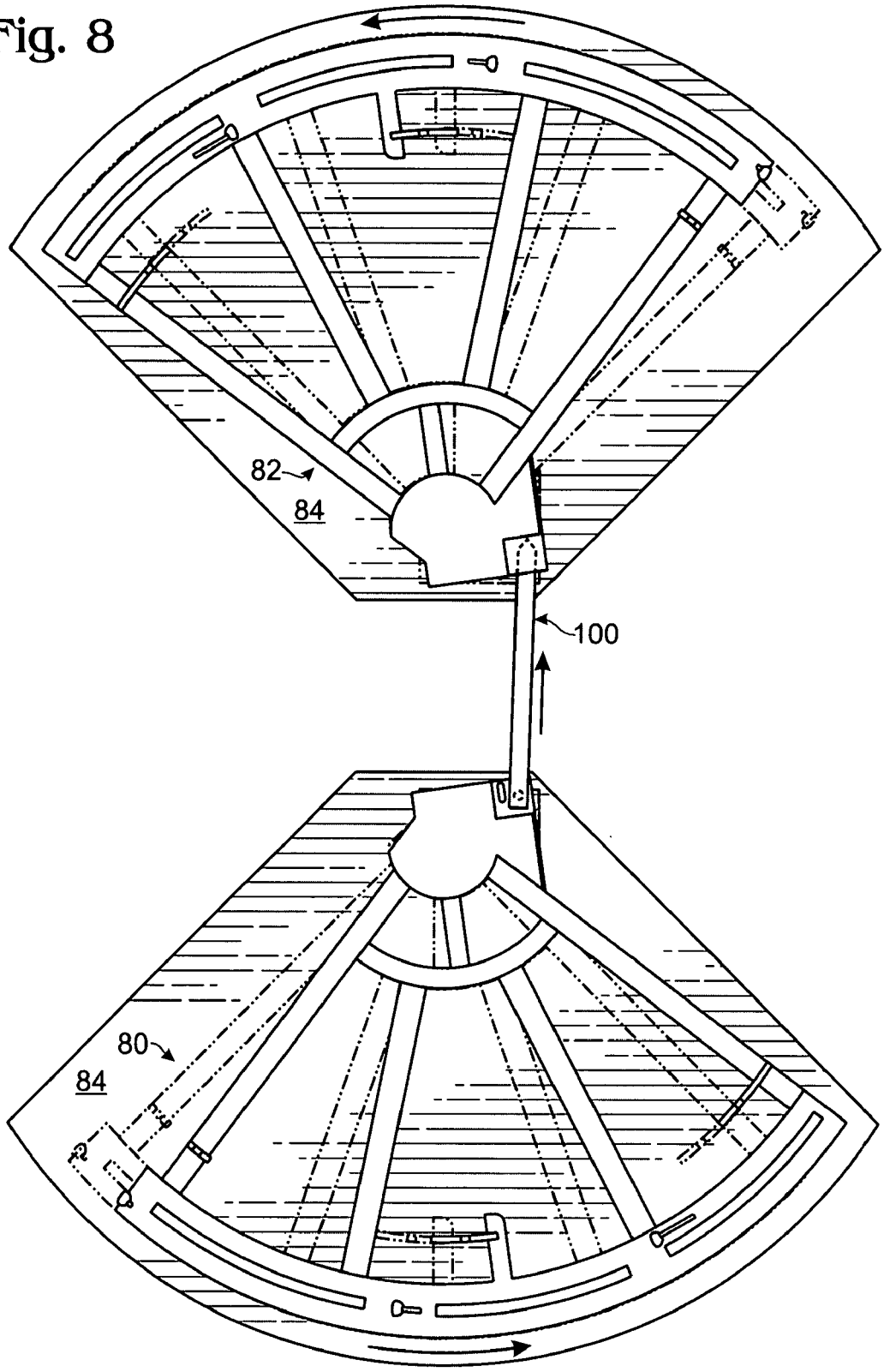
FIG. 8 shows a link operatively connecting the first and second trigger assemblies of FIG. 6.

FIG. 8 shows first common triggering assembly 80 operatively connected to second common triggering assembly 82 by a link 100. The link translates movement from one common triggering assembly to the other common triggering assembly. Linking the movement of one common triggering assembly to the other common triggering assembly allows cooperative activation of launchers 12*a*, 12*b*, and 12*c* with launchers 12*d*, 12*e*, and 12*f*. In other words, user-manipulable lever 90*a* can be pressed to fire launchers 12*a* and 12*f* in one triggering motion; user-manipulable lever 90*b* can be pressed to fire launchers 12*a*, 12*b*, 12*e*, and 12*f* in one triggering motion; and user-manipulable lever 90*c* can be pressed to fire all six launchers in one triggering motion.

Turning back to FIG. 6, it can be seen that link 100 can be disengaged so that common trigger assembly 80 is disconnected from common trigger assembly 82. In such a configuration, the common trigger assemblies do not move together, thus allowing launchers 12*a*, 12*b*, and 12*c* to be activated independently of launchers 12*d*, 12*e*, and 12*f*.

The above described triggering mechanism is provided as a nonlimiting example. It is to be understood that any triggering mechanism that can be used to activate one or more launchers for firing a collision vehicle into the collision zone can be used without departing from the scope of this disclosure.

While the present invention has been described in terms of specific embodiments, it should be appreciated that the spirit and scope of the invention is not limited to those embodiments. The scope of the invention is instead indicated by the appended claims. All subject matter which comes within the meaning and range of equivalency of the claims is to be embraced within the scope of the claims.

The invention claimed is:

1. A toy vehicle track set, comprising:

a jump to launch a target vehicle across a gap;

a loop to receive the target vehicle from the jump after the target vehicle crosses the gap, the loop then directing the target vehicle upward to an apex of the loop and then downward around the loop until launching the target vehicle across the gap;

a landing to receive the target vehicle from the loop after the target vehicle crosses the gap;

a first plurality of launchers, each launcher being configured to propel a different collision vehicle laterally through the gap from a different launch point so that a collision vehicle engages the target vehicle when both of the vehicles are in the gap, each launcher including a thruster that engages and propels the collision vehicle in the launcher, each of the first plurality of launchers being activated by a first common trigger assembly; and a second plurality of launchers, each launcher of the second plurality of launchers being configured to propel a different collision vehicle throuhg the gap from a different launch point.

2. The toy vehicle track set of claim 1, where the first common trigger assembly is capable of activating each of the first plurality of launchers substantially simultaneously.

3. The toy vehicle track set of claim 1, where the first common trigger assembly is capable of sequentially activating each of the first plurality of launchers.

4. The toy vehicle track set of claim 1, where each of the second plurality of launchers is activated by a second common trigger assembly.

5. The toy vehicle track set of claim 4, further comprising a link to operatively connect the first common trigger assembly and the second common trigger assembly for cooperative activation of the first plurality of launchers and the second plurality of launchers.

6. The toy vehicle collision set of claim 1, wherein the first plurality of launchers is located on a first side of the gap and are directed upwardly toward the gap, the second plurality of launchers is located on a second side of the gap and are directed upwardly toward the gap, the second side being on the opposite side of the gap from the first side, and each of the launchers includes a spring-biased thruster that engages and propels a collision vehicle toward the gap.

7. A toy vehicle track set, comprising:

a track for directing a target vehicle along a path of travel, the track including:

a jump segment to launch the target vehicle into an airborne path of travel, the airborne path of travel being defined by a gap; and a landing segment to catch the target vehicle from the airborne path of travel;

a first plurality of launchers, each launcher being configured to propel a different collision vehicle across the airborne path of travel of the target vehicle into the gap, each launcher including a thruster that engages the collision vehicle to propel the collision vehicle, each of the first plurality of launchers being activated by a first common trigger assembly; and a second plurality of launchers, each launcher of the second plurality of launchers being configured to propel a different collision vehicle through the airborne path of travel of the target vehicle.

8. The toy vehicle track set of claim 7, where the first common trigger assembly is capable of activating each of the first plurality of launchers substantially simultaneously.

9. The toy vehicle track set of claim 7, where the first common trigger assembly is capable of sequentially activating each of the first plurality of launchers.

10. The toy vehicle track set of claim 7, where each of the second plurality of launchers is activated by a second common trigger assembly.

11. The toy vehicle track set of claim 10, further comprising a link to operatively connect the first common trigger assembly and the second common trigger assembly for cooperative activation of the first plurality of launchers and the second plurality of launchers.

12. A toy vehicle collision set, comprising:

a closed-loop track having a jump segment, a loop, and a landing, the jump segment directing a target vehicle in an airborne path of travel through a collision zone to the loop, and the loop directing the target vehicle through the collision zone to the landing, the collision zone being defined by the gap between the jump segment, the loop, and the landing;

a first launcher to propel a first collision vehicle through the air to the collision zone from a first launch point, the first launcher having a first thruster that engages the first collision vehicle to propel the first collision vehicle upwardly to the collision zone;

a second launcher to propel a second collision vehicle through the air to the collision zone from a second launch point, the second launcher having a second thruster that engages the second collision vehicle to propel the second collision vehicle upwardly to the collision zone; and a first trigger assembly to selectively activate the first and second launchers to release the first and second thrusters, where the first trigger assembly activates the first and second launchers sequentially in a first operating mode, and where the first trigger assembly activates the first and second launchers substantially simultaneously in a second operating mode.

13. The toy vehicle collision set of claim 12, further comprising:

a third launcher to propel a third collision vehicle through the air to the collision zone from a third launch point;

a fourth launcher to propel a fourth collision vehicle through the air to the collision zone from a fourth launch point; and a second trigger assembly to selectively activate the third and fourth launchers, where the second trigger assembly activates the third and fourth launchers sequentially in a first operating mode, and where the second trigger assembly activates the third and fourth launchers substantially simultaneously in a second operating mode.

14. The toy vehicle collision set of claim 13, further comprising:

a link operatively connecting the first and second trigger assemblies so that the first and second trigger assemblies cooperate to activate the first and third launchers together and to activate the second and fourth launchers together.

15. The toy vehicle collision set of claim 13, wherein the first and second launch points are on a first side of the collision zone, and the third and fourth launch points are on a second side of the collision zone, the second side being opposite to the first side.

16. The toy vehicle collision set of claim 13, wherein the first launcher is configured to receive the first collision vehicle, the first thruster is retained in a loaded position, and the first thruster propels the first collision vehicle as the first thruster is moved from its loaded position to a released position by a biasing mechanism.

17. The toy vehicle collision set of claim 12, wherein the first and second launch points are on the same side of the collision zone, and the first and second launchers are oriented at different angles relative to the collision zone.

* * * * *